US007540393B2

(12) United States Patent
Wong

(10) Patent No.: US 7,540,393 B2
(45) Date of Patent: Jun. 2, 2009

(54) LITTER BIN WITH PIVOTAL LID AND AUTOMATIC LATCHING MECHANISM

(75) Inventor: Michael P. Wong, Phoenix, AZ (US)

(73) Assignee: Rehrig Pacific Company, Los Angeles, CA (US)

( * ) Notice: Subject to any disclaimer, the term of this patent is extended or adjusted under 35 U.S.C. 154(b) by 687 days.

(21) Appl. No.: 10/952,157

(22) Filed: Sep. 27, 2004

(65) Prior Publication Data

US 2006/0065657 A1 Mar. 30, 2006

(51) Int. Cl.
*B65D 45/16* (2006.01)
*E05C 3/12* (2006.01)

(52) U.S. Cl. ..... 220/324; 220/908; 292/230; 292/304; 292/DIG. 4

(58) Field of Classification Search ..... 220/324, 220/485.06, 908, 9.1–9.4, 833, 495.06; 292/230, 292/341.17, 238, 304, DIG. 4, DIG. 11; D34/7, D34/8, 10, 11; 232/38, 39, 44
See application file for complete search history.

(56) References Cited

U.S. PATENT DOCUMENTS 1,364,209 A * 1/1921 Richardson ..... 232/1 R
1,380,252 A * 5/1921 Richardson ..... 232/43.2
1,424,519 A * 8/1922 Richardson ..... 40/306
1,424,520 A * 8/1922 Richardson et al. ..... 220/254.2
2,969,891 A * 1/1961 Presnick ..... 220/640
D229,279 S * 11/1973 Kay et al. ..... D34/1
3,793,756 A * 2/1974 Kay et al. ..... 40/306
3,803,738 A * 4/1974 Weiss ..... 40/306
D234,288 S * 2/1975 Kay et al. ..... D34/1
4,155,584 A * 5/1979 Pracchia ..... 294/68.26
4,182,530 A * 1/1980 Hodge ..... 294/68.26
RE30,890 E 3/1982 Hodge
D265,542 S * 7/1982 Hanson et al. ..... D34/11
D312,523 S * 11/1990 Delmerico et al. ..... D34/7
5,011,360 A * 4/1991 Abram et al. ..... 414/424
5,015,021 A 5/1991 Wyson et al.
5,041,728 A * 8/1991 Spacher et al. ..... 250/366
5,042,856 A * 8/1991 Goodman ..... 292/259 R
5,085,341 A * 2/1992 Hodge ..... 220/811
5,094,358 A * 3/1992 Serio, Sr. ..... 220/315
5,094,487 A * 3/1992 Drewry ..... 292/237
5,105,967 A 4/1992 Horpestad
5,118,000 A * 6/1992 Howell et al. ..... 220/315
5,135,129 A * 8/1992 Joly ..... 220/315
5,149,153 A * 9/1992 Drewry et al. ..... 292/104
5,201,434 A * 4/1993 DeVivo et al. ..... 220/315
5,217,267 A * 6/1993 Yagi ..... 292/338
5,224,744 A * 7/1993 Michelutti ..... 292/234
D346,056 S * 4/1994 Keeney ..... D34/8
5,415,314 A 5/1995 McCollum
5,423,419 A * 6/1995 Wentz et al. ..... 206/6
5,474,341 A * 12/1995 Putman et al. ..... 292/230

(Continued)

*Primary Examiner*—Anthony D Stashick
*Assistant Examiner*—Ned A Walker
(74) *Attorney, Agent, or Firm*—Carlson, Gaskey & Olds

(57) ABSTRACT

A litter bin includes a lid hingeably connected to a container. Opposite the hinge, a latch selectively secures the lid to the container. The latch includes a pivotably mounted latch member that has a center of gravity offset from its pivot point. The latch member also includes a catch portion that moves between a locked position and an unlocked position upon pivoting of the latch member. Because the center of gravity of the latch member is offset from the pivot point, tilting the litter bin causes pivoting of the latch member, thereby moving the catch portion from the locked position to the unlocked position.

3 Claims, 9 Drawing Sheets

U.S. PATENT DOCUMENTS 5,490,606 A * 2/1996 Lombardo ..... 220/324
5,599,050 A * 2/1997 Tinsley ..... 292/230
5,662,364 A * 9/1997 Reeb et al. ..... 292/230
5,683,126 A * 11/1997 DeVivo et al. ..... 292/230
5,738,395 A * 4/1998 Probst ..... 292/230
5,772,061 A * 6/1998 Lowe ..... 220/254.3
5,772,264 A * 6/1998 Bettenhausen ..... 292/130
5,997,052 A * 12/1999 Reeb et al. ..... 292/148
6,176,388 B1 * 1/2001 Orndorff ..... 220/662
6,290,093 B1 * 9/2001 Obriot et al. ..... 220/835
D465,312 S * 11/2002 Perelli et al. ..... D34/7
6,666,485 B1 * 12/2003 Moret ..... 292/130
D487,539 S * 3/2004 Moroney ..... D34/7
6,808,080 B2 * 10/2004 Spiers et al. ..... 220/263
D537,222 S * 2/2007 Presnell ..... D34/7
D551,414 S * 9/2007 Weiss ..... D34/1
2003/0168466 A1 * 9/2003 Spiers et al. ..... 220/835
2006/0180588 A1 * 8/2006 Cavalcante ..... 220/324

* cited by examiner

LITTER BIN WITH PIVOTAL LID AND AUTOMATIC LATCHING MECHANISM

BACKGROUND OF THE INVENTION

This invention relates to litter bins and more particularly to a litter bin having a gravity activated lock for a lid.

Litter bins are often used in outdoor environments and include a container defining an opening over which a lid is removably attached. Side openings in the lid and/or container permit people to throw away litter into the container. The lid must be removed to empty the litter bin. Some litter bins includes manually actuated latches to secure the lid to the container. This makes it more difficult to removed the lid and empty the litter bin. In particular, this makes it difficult for automated handling equipment to lift and empty the contents of the litter bins.

SUMMARY OF THE INVENTION

A litter bin according to the present invention includes a lid hingeably connected to a container. Opposite the hinge, a latch normally keeps the lid latched to the container. The latch is gravity-actuated, such that the lid is released when the litter bin is tilted sufficiently, thus making it easy to open the lid and empty the litter bin.

The latch includes a pivotably mounted latch member that has a center of gravity offset from its pivot point. The latch member also includes a catch portion that moves between a locked position and an unlocked position upon pivoting the latch member. Because the center of gravity of the latch member is offset from the pivot point, tilting the litter bin causes pivoting of the latch member, thereby moving the catch portion from the locked position to the unlocked position.

Because the latch is gravity-actuated, the lid is released automatically simply by tilting the litter bin while emptying it. Therefore, automated handling equipment need only lift and tilt the litter bin to empty it, without having to actuate the latch separately.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
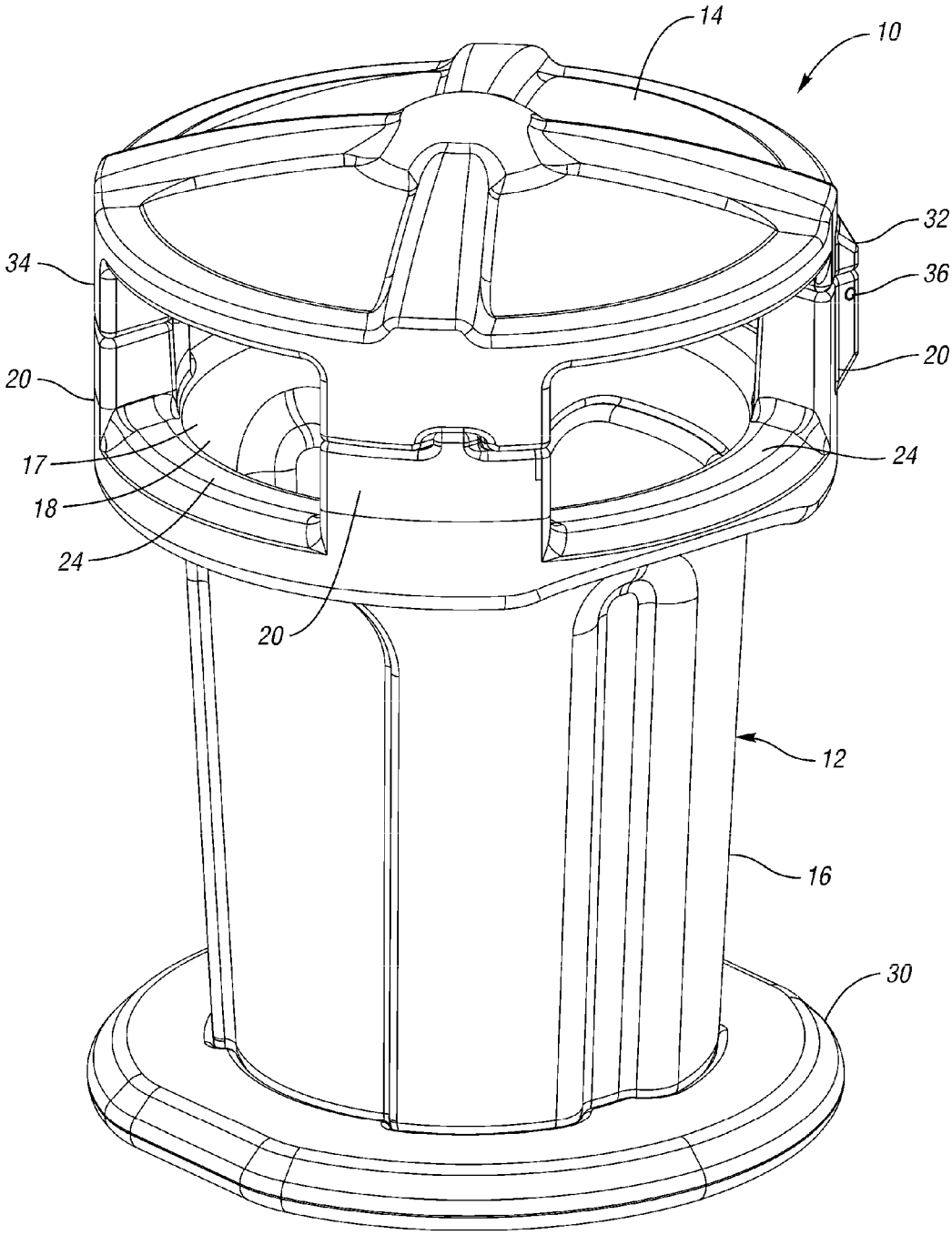
FIG. 1 is a perspective view of a litter bin according to the present invention.

A litter bin 10 is shown in FIG. 1 including a body or container 12 with a lid 14 attached thereto. The container 12 includes a roughly cylindrical wall 16 defining an interior 17 and an opening 18 at the upper end of the wall 16 leading to the interior 17. A plurality of columns 20 extend upwardly from the wall 16, thereby defining openings 24. A base 30 is mounted to a lower end of the wall 16. While the embodiment show herein is directed to a litter bin, it is understood that the concepts described and shown herein could also apply to various container/lid combinations.

Figure 2:
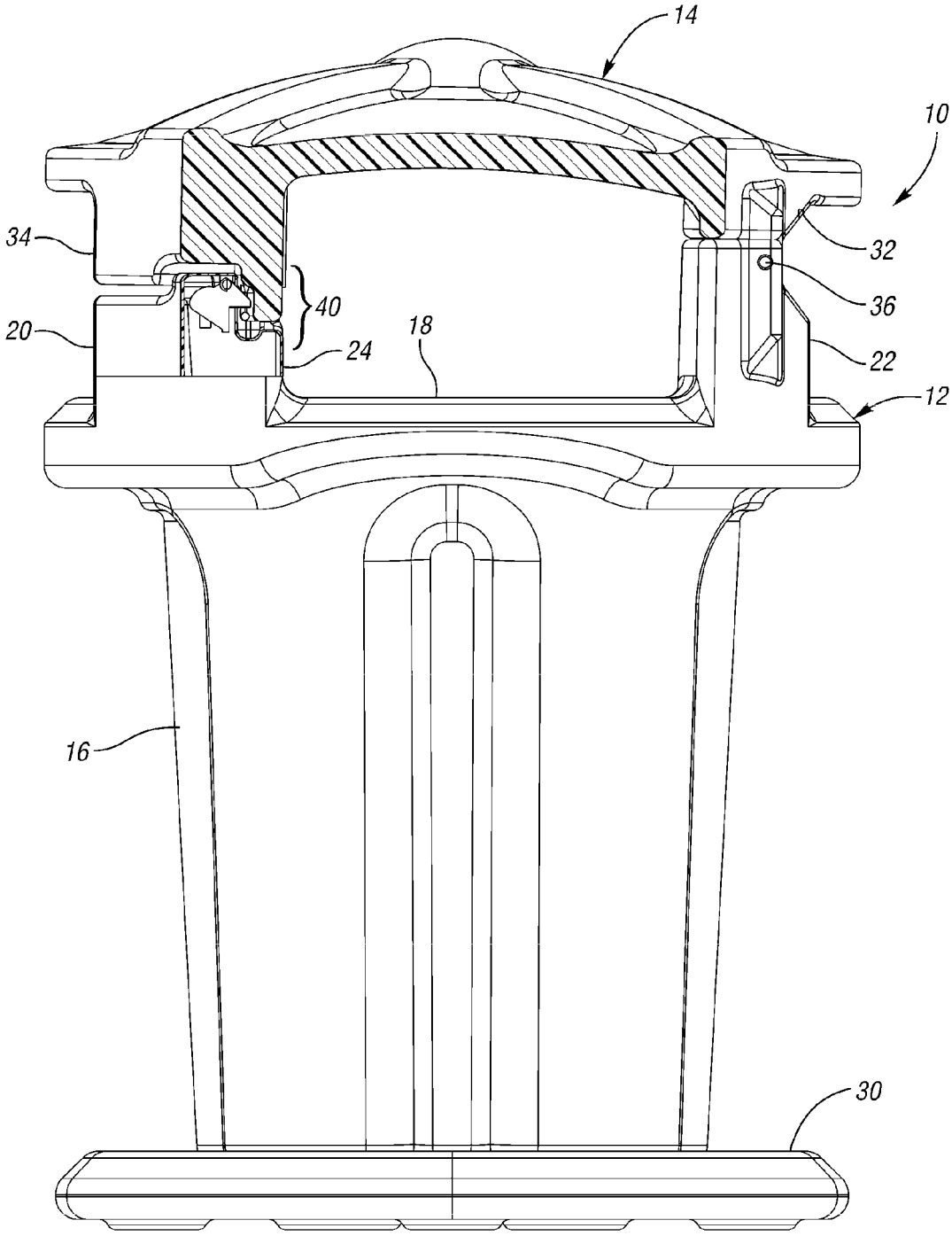
FIG. 2 is a side view, partially broken away, of the litter bin of FIG. 1.

The lid 14 has a rearward end 32 opposite a forward end 34 that extends downwardly and mates with a column 20 extending upwardly from the container 12. The rearward end 32 of the lid 14 is connected to another column 20 of the container 12 via a hinge 36. As shown in FIG. 2, the forward end 34 of the lid 14 is releasably secured to the column 20 of the container 12 via a latch system 40.

Figure 3:
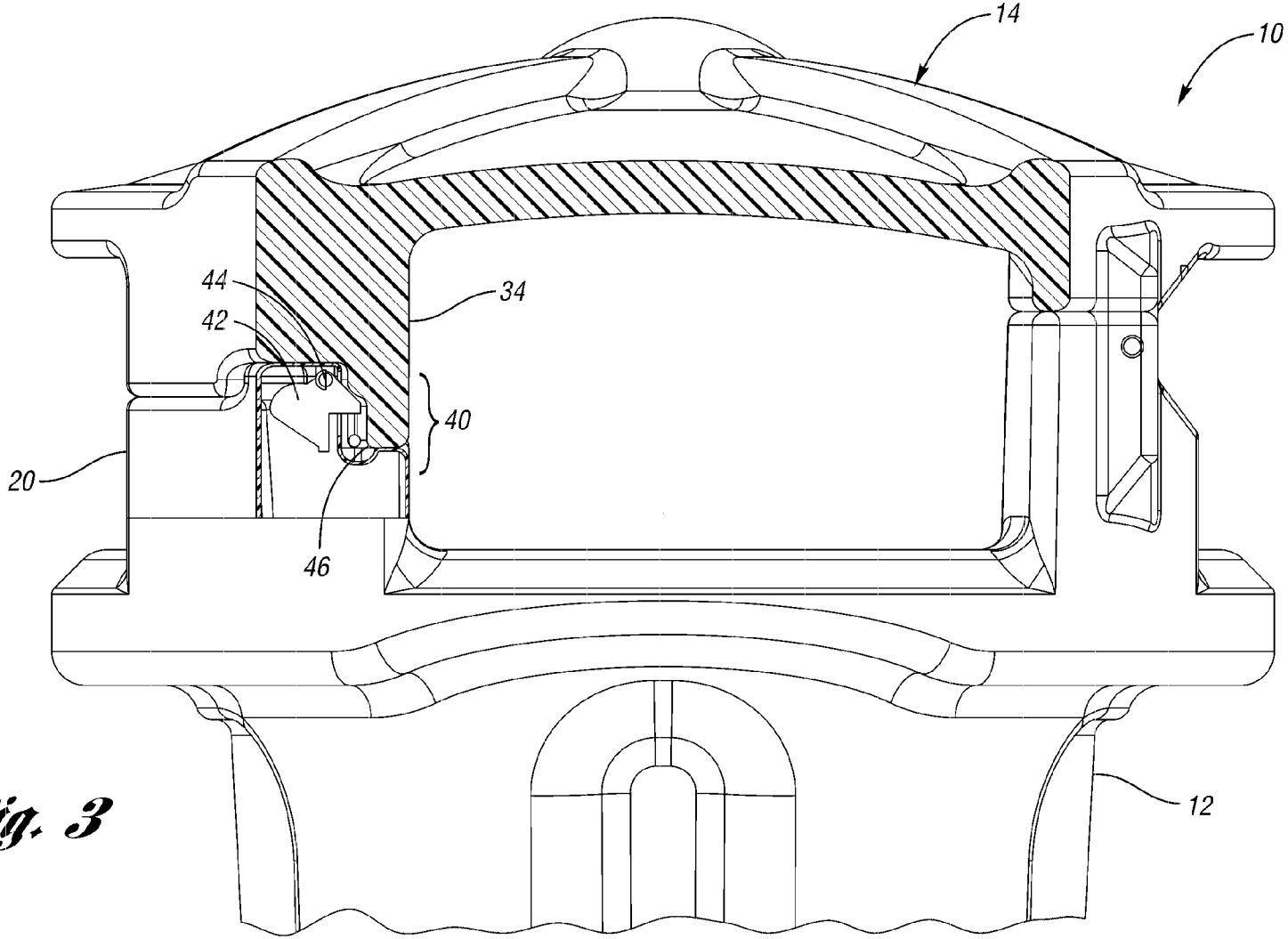
FIG. 3 is an enlarged view of the hinge and latch area of FIG. 2.

Referring to FIG. 3, the latch system 40 generally includes a latch member 42 pivotably mounted to the column 20 of the container 12 by a pivot pin 44. The latch further includes a latch receiver 46 at a lower end of the forward end 34 of the lid 14.

Figure 4:
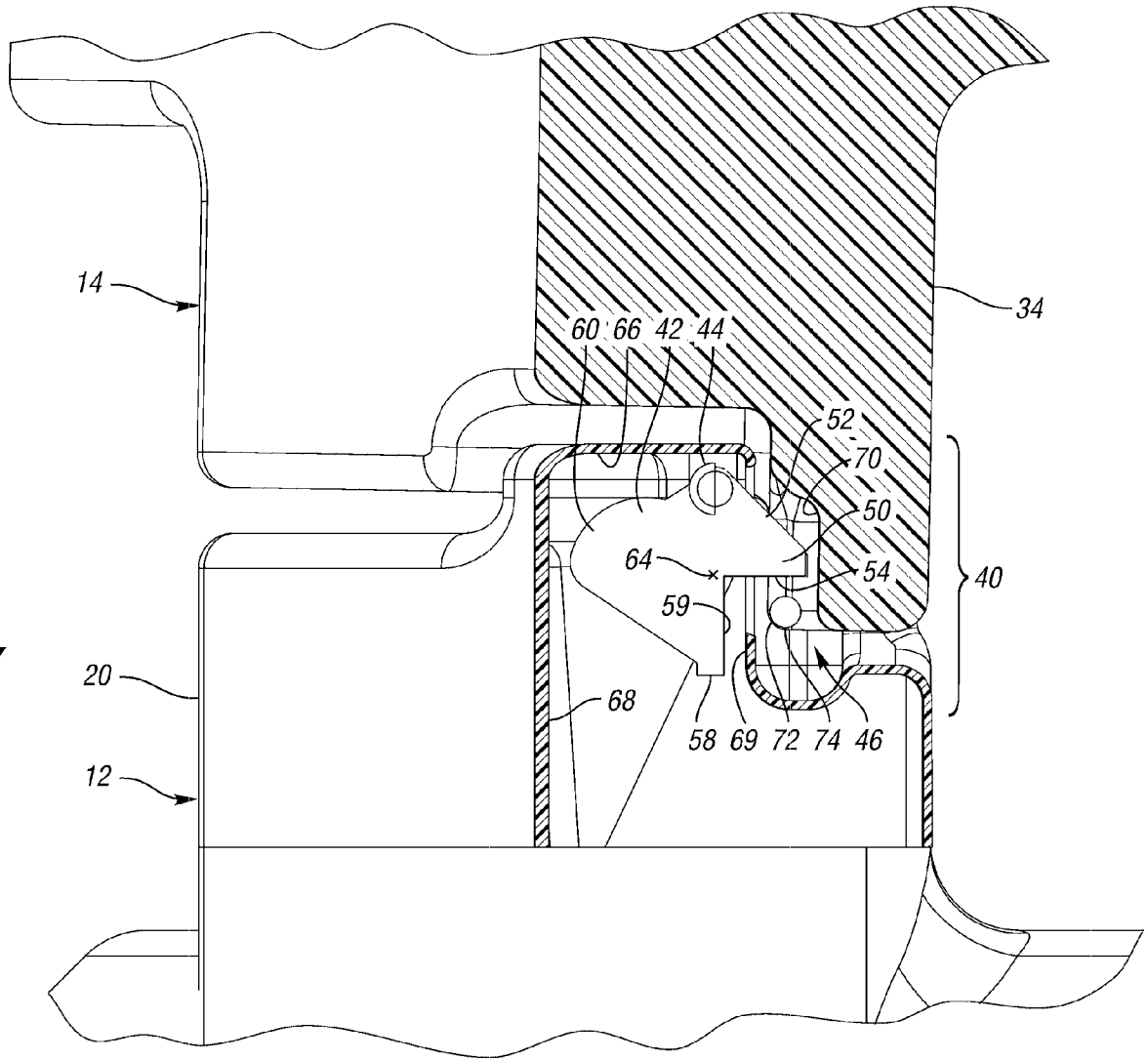
FIG. 4 is an enlarged view of the latch of FIG. 3, with the latch in a latched position.

FIG. 4 is an enlarged view of the latch of FIG. 3, with the latch in a latched position. The latch member 42 includes a catch portion 50 extending outwardly away from the pivot pin 44. The catch portion 50 includes an inclined leading upper edge 52 adjacent a horizontal shoulder 54. The latch member 42 further includes a leg portion 58 extending vertically downward from the pivot pin 44 and defining a large recess 59 between the leg portion 58 and the shoulder 54 of the catch portion 50. A large abutment member 60 protrudes rearwardly from the latch member 42 away from the pivot pin 44. The shape, size and thickness of the various portions of the latch member 42 are determined such that the center of gravity 64 of the latch member 42 is positioned directly below the pivot pin 44 and is spaced substantially away from the pivot pin 44.

The latch member 42 is pivotably mounted on pivot pin 44 within a recess 68 inside the column 20 of the container 12. The recess 68 includes an upper surface 66 for contact by the abutment member 60 to limit rotation of the latch member 68 in that direction. The recess 68 also includes a forward stop 69 below the shoulder 54 of the catch portion 50 and in front of the leg portion 58.

Figure 5:
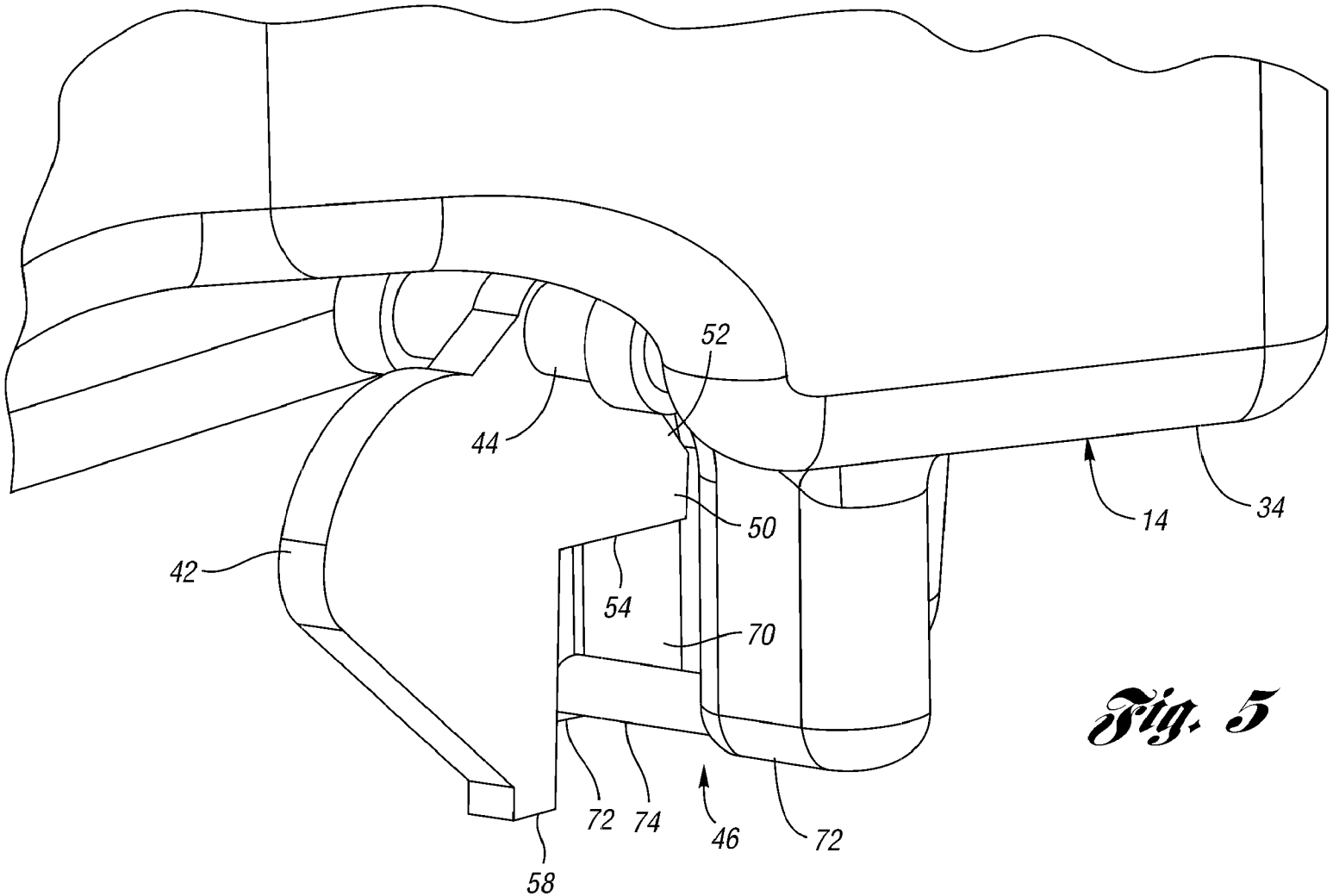
FIG. 5 is perspective view of the latch of FIG. 4.

As can be seen in FIGS. 4 and 5, the latch receiver 46 includes a recess 70 between a pair of spaced apart arms 72 extending downwardly from the forward end 34 of the lid 14. A stop pin 74 is mounted between the arms 72. In the latched position shown in FIGS. 4 and 5, the catch portion 50 of the latch member 42 is disposed in the recess 70 of the latch receiver 46 with the shoulder 54 of the catch portion 50 disposed above the stop pin 74.

Figure 6:
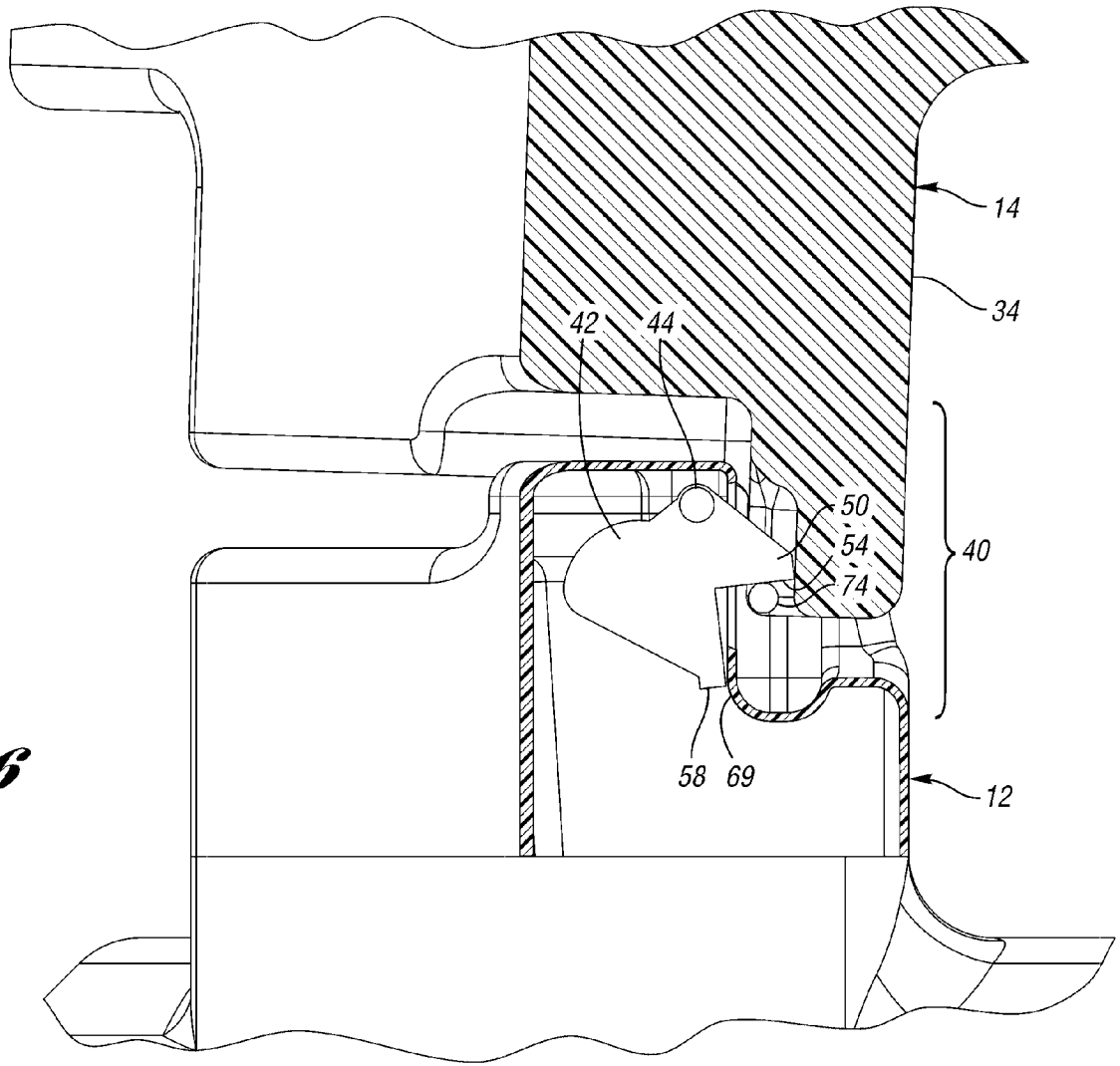
FIG. 6 shows the latch in a view similar to that of FIG. 4, with the latch preventing opening of the lid.

FIG. 6 shows the latch system 40 preventing opening of the lid 14. When the catch portion 50 is in the latched position shown in FIGS. 4 and 5 and the lid 14 is lifted, the stop pin 74 contacts the shoulder 54 of the catch portion 50. This causes the latch member 42 to rotate slightly until the leg portion 58 contacts the forward stop 69, thereby prohibiting further rotation in that direction and, consequently, prohibiting lifting the lid 14 any further.

Figure 7:
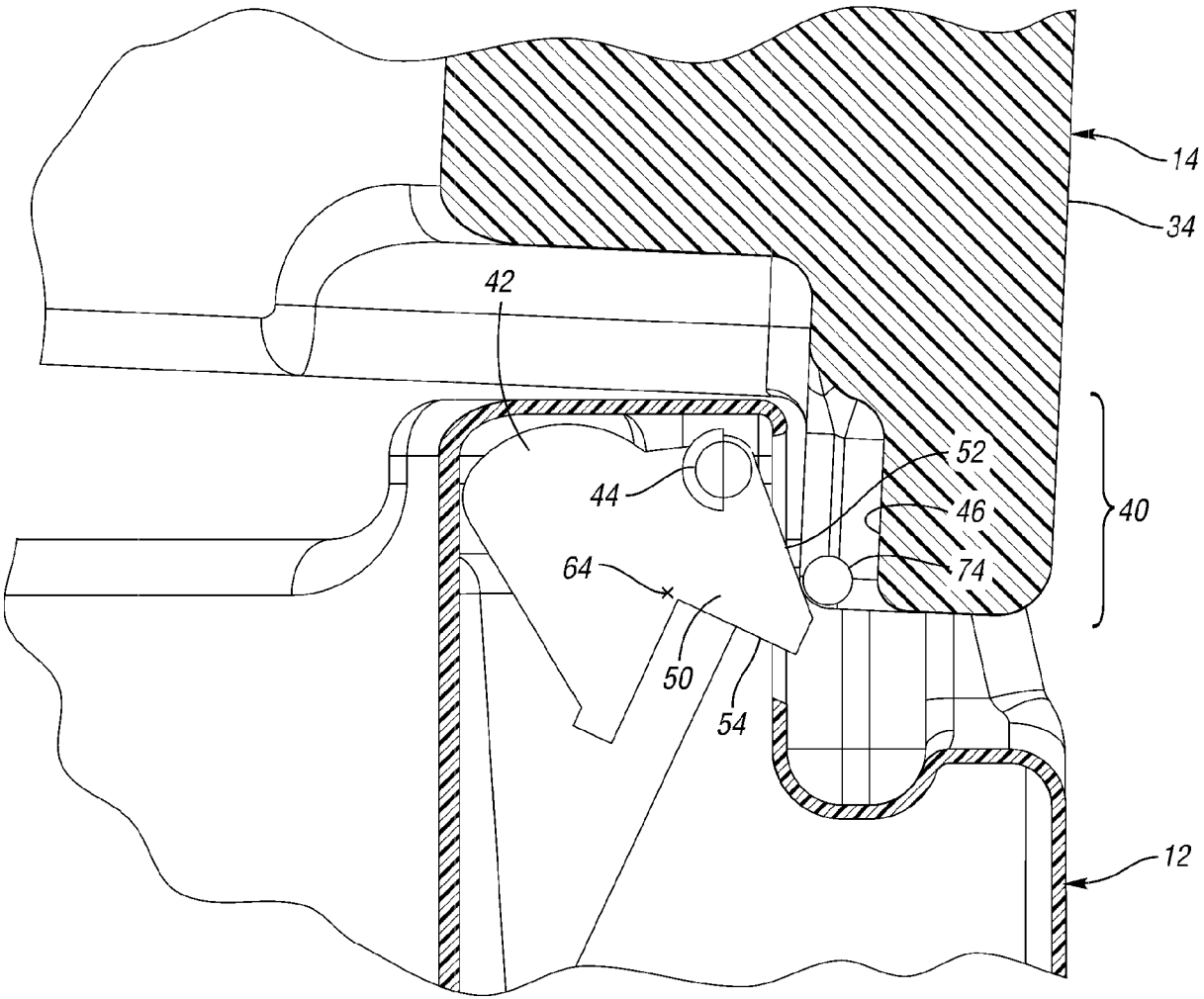
FIG. 7 shows the latch permitting closing of the lid.

The latch system 40 permits the lid 14 to be closed as shown in FIG. 7. When the lid 14 is moved downwardly, the stop pin 74 contacts the inclined leading upper edge 52 of the catch portion 50, thereby rotating the latch member 42 away. When the stop pin 74 passes below the catch portion 50, the center of gravity 64 urges the latch member 42 back toward the latch receiver 46. The catch portion 50 then returns to the latched position shown in FIGS. 4 and 5.

Figure 8:
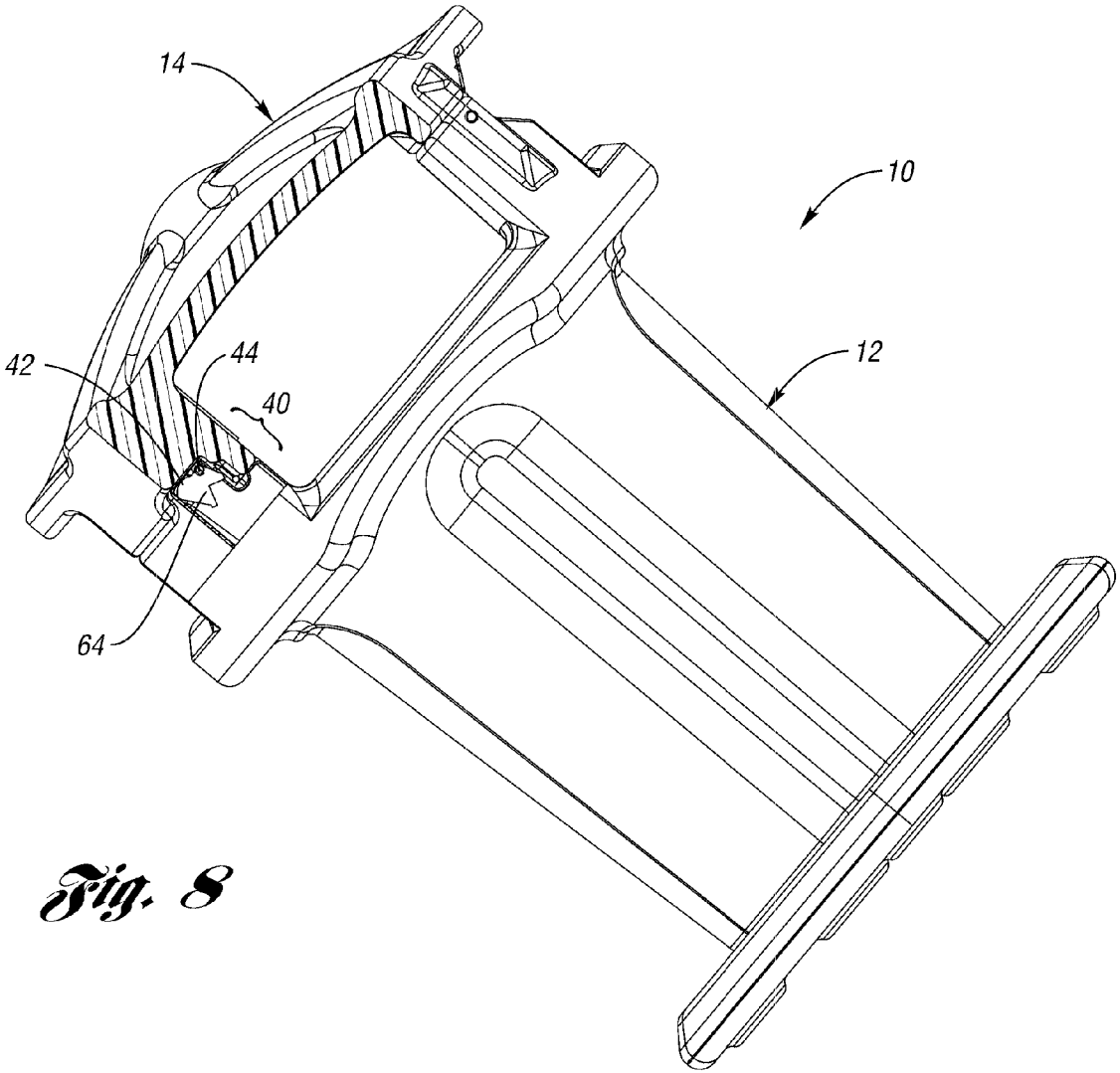
FIG. 8 is a side view of the litter bin of FIG. 2 being tilted to one side to release the latch.
Figure 9:
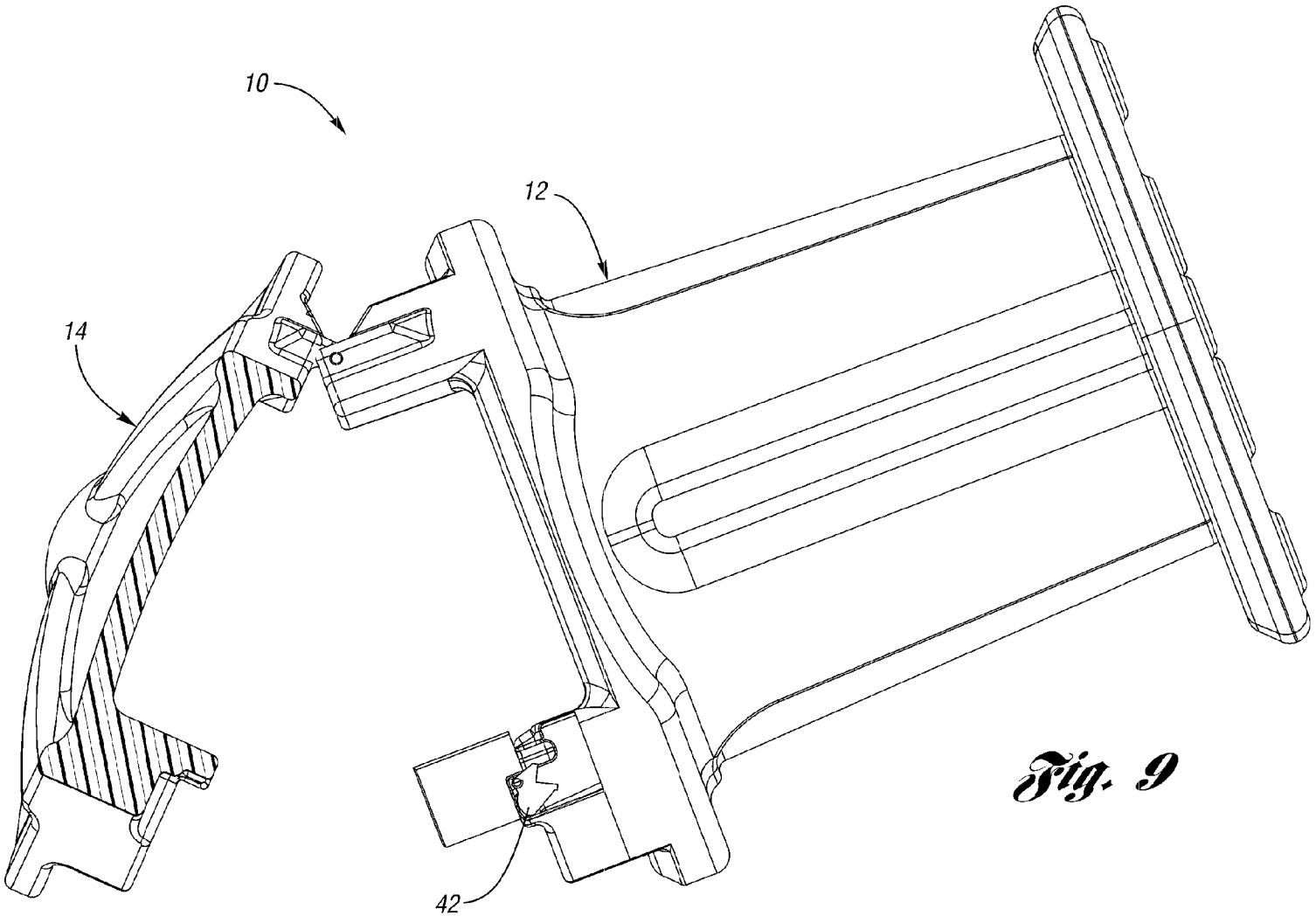
FIG. 9 shows the litter bin of FIG. 8 in a position to be emptied, with the lid hinged open.

To subsequently release the latch system 40, the litter bin 10 is tilted forward toward the latch system 40 as shown in FIG. 8. This causes the latch member 42 to pivot relative to the litter bin 10, to keep the center of gravity 64 of the latch member 42 below the pivot pin 44. This releases the latch system 40, and the lid 14 can be opened and the container 12 can be emptied as shown in FIG. 9.

Because the latch system 40 is gravity-actuated, the lid 14 is released automatically simply by tilting the litter bin 10 while emptying it. Therefore, automated handling equipment need only lift and tilt the litter bin 10 to empty it, without having to actuate the latch system 40 separately.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. There are different designs of containers that would benefit from the present invention.

What is claimed is:

1. A container and lid assembly comprising:

a container having a wall defining an upper opening to an interior of the container, the container including a first column portion extending upwardly from an upper edge of the wall;

a lid for selectively covering the upper opening, the lid including a second column portion extending downwardly toward the first column portion of the container;

a latch selectively connecting the lid to the container over the opening, the latch including a latch member and a latch receiver, the latch member being pivotably mounted in one of the first column portion and the second column portion, the latch receiver being mounted in the other of the first column portion and the second column portion, the latch member having a center of gravity spaced away from a pivot point of the latch member, the latch member having a catch portion movable between a first position and a second position upon pivoting of the latch member, the catch portion impeding movement of the lid away from the container when the catch portion is in the first position and permitting movement of the lid away from the container when the catch portion in the second position, wherein the latch is concealed in the first column portion and the second column portion.

2. The container and lid assembly of claim 1 wherein an upper surface of the first column portion contacts a lower surface of the second column portion in a closed position.

3. The container and lid assembly of claim 1 wherein the first column portion is integrally formed with the container and the second column portion is integrally formed with the lid.

* * * * *